US007699004B2

(12) United States Patent
Muro

(10) Patent No.: US 7,699,004 B2
(45) Date of Patent: Apr. 20, 2010

(54) DIRECT LOAD, DETONATOR-LESS CONNECTOR FOR SHOCK TUBES

(75) Inventor: Jose Maria Ayensa Muro, Galdakao-Vizcaya (ES)

(73) Assignee: Maxamcorp, S.A.U., Madrid (ES)

( * ) Notice: Subject to any disclaimer, the term of this patent is extended or adjusted under 35 U.S.C. 154(b) by 370 days.

(21) Appl. No.: 11/569,000

(22) PCT Filed: May 16, 2005

(86) PCT No.: PCT/EP2005/005441

§ 371 (c)(1),
(2), (4) Date: Jan. 11, 2007

(87) PCT Pub. No.: WO2005/111534

PCT Pub. Date: Nov. 24, 2005

(65) Prior Publication Data

US 2008/0257191 A1 Oct. 23, 2008

(30) Foreign Application Priority Data

May 19, 2004 (ES) ..... 200401201

(51) Int. Cl.
*C06C 5/00* (2006.01)
*C06C 5/06* (2006.01)
*F42D 1/00* (2006.01)
*F42D 1/04* (2006.01)

(52) U.S. Cl. ..... 102/275.8; 102/275.11; 102/275.12

(58) Field of Classification Search ... 102/275.1–275.8, 102/275.11, 275.12; D22/112
See application file for complete search history.

(56) References Cited

U.S. PATENT DOCUMENTS

| | | | | | |
|---|---|---|---|---|---|
| 3,205,818 | A | * | 9/1965 | Coulson | 102/275.4 |
| 4,248,152 | A | * | 2/1981 | Yunan | 102/275.4 |
| 4,714,017 | A | * | 12/1987 | Kelly et al. | 102/275.3 |
| 4,796,533 | A | * | 1/1989 | Yunan | 102/322 |
| 5,012,741 | A | * | 5/1991 | Peebles et al. | 102/275.4 |
| 5,171,935 | A | * | 12/1992 | Michna et al. | 102/275.7 |
| 5,204,492 | A | * | 4/1993 | Jacob et al. | 102/275.12 |
| 5,398,611 | A | * | 3/1995 | Michna et al. | 102/275.7 |
| 5,413,046 | A | * | 5/1995 | Sobczak et al. | 102/275.7 |

(Continued)

FOREIGN PATENT DOCUMENTS

GB 2140137 11/1984

(Continued)

*Primary Examiner*—Bret Hayes
(74) *Attorney, Agent, or Firm*—Moore & Van Allen, PLLC; Tristan A. Fuierer

(57) ABSTRACT

The connector block allows the transmission of the shock wave that travels along the donor tube (1) to several receiver tubes (4), setting between them a delay device (6) with its corresponding pyrotechnic delay formula (8), and an explosive charge (9), all these components being integrated within the body (4) of the connector block in such a way that the explosive charge (9) is parallel and adjacent to the receiver tubes (10), which are on a parallel plane to said explosive charge and are positioned at right angles to it, inside which a detonator is housed. The explosive charge (9) is positioned so that all the tubes (10) held in the slot (11) are initiated in similar conditions, without suffering the effects of structural differences, thus achieving a homogeneous and safe initiation that does not produce metal shrapnel that could damage the receiver tubes (10).

20 Claims, 6 Drawing Sheets

U.S. PATENT DOCUMENTS

| | | | | |
|---|---|---|---|---|
| 5,417,162 | A * | 5/1995 | Adams et al. | 102/317 |
| 5,423,263 | A * | 6/1995 | Rontey et al. | 102/275.12 |
| 5,499,581 | A * | 3/1996 | Sutula, Jr. | 102/275.12 |
| 5,594,196 | A | 1/1997 | Rontey et al. | |
| 5,631,440 | A * | 5/1997 | Thureson et al. | 102/275.7 |
| 5,703,319 | A * | 12/1997 | Fritz et al. | 102/275.7 |
| 5,792,975 | A * | 8/1998 | Tseka et al. | 102/275.7 |
| 6,305,287 | B1 * | 10/2001 | Capers et al. | 102/275.7 |
| 6,349,648 | B1 * | 2/2002 | Capers et al. | 102/275.4 |
| 6,425,332 | B1 * | 7/2002 | Capers et al. | 102/318 |
| 6,513,437 | B2 * | 2/2003 | Chan et al. | 102/275.7 |
| 6,681,701 | B2 * | 1/2004 | Perry | 102/275.7 |
| 6,694,886 | B1 * | 2/2004 | Woodall et al. | 102/275.1 |
| 7,188,566 | B2 * | 3/2007 | Gladden | 102/275.11 |
| 2004/0055494 | A1 * | 3/2004 | O'Brien | 102/275.12 |
| 2005/0034625 | A1 * | 2/2005 | Chan et al. | 102/275.12 |

FOREIGN PATENT DOCUMENTS

| | | |
|---|---|---|
| WO | 02085818 | 10/2002 |
| WO | 2004029003 | 4/2004 |

* cited by examiner

DIRECT LOAD, DETONATOR-LESS CONNECTOR FOR SHOCK TUBES

CROSS-REFERENCE TO RELATED APPLICATIONS

This application is filed under the provisions of 35 U.S.C. §371 claims the priority of International Patent Application No. PCT/EP2005/005441 filed on 16 May 2005, which in turn claims priority of Application No. P200401201 (Spain) filed on 19 May 2004.

OBJECT OF THE INVENTION

The present invention refers to a connector block of the type used for the proper initiation of sequential blasts using non-electric detonators, specifically those that are carried out using detonators initiated via shock tube.

The object of the invention is to transmit the shock wave that travels along the donor tube to one or several receiver tubes, introducing a predetermined delay between them, with the special characteristic that the transmission is made without a detonator, as all the components are integrated into the connector block.

The connector block is particularly for use in mining, large-scale public works and generally for any other practical situation where it is necessary to carry out sequential blasts.

BACKGROUND OF THE INVENTION

Until about 1970, sequential blasts were carried out almost exclusively using electric detonators that were connected to each other following the usual techniques for electrical circuits, that is, series connections and parallel connections.

These blasts were also carried out by initiating them using a detonator cord and sequencing them by means of so-called "detonator cord relays" that consisted of metal or plastic sections that would allow the donor and receiver detonating cords to be linked, inserting a specific delay time between their respective detonations.

It seems that for non-electric detonators initiated via shock tube, it was necessary to develop connection systems that allowed sequential blasts to be designed and carried out for a large number of blast-holes, which was mainly achieved by starting the blast-hole detonators via trunk lines of detonating cord or by means of surface detonators (the same for non-electric detonators initiated via shock tube).

In both cases (trunk lines of detonating cord and the use of surface detonators) duct tape was used to fix the tubes that were going to be initiated (receivers) to the detonating cord or to the detonator that was going to initiate them (donor), a slow and imprecise method that gave rise to the use of fast connectors, which were generally made of plastic.

The connectors used to initiate receiver shock tubes by means of detonators consisted of small plastic boxes inside which the detonator was housed, and they had a cover on the side which allowed the detonator tubes that were going to be initiated (receivers) to be attached and fixed to the housing of the detonator that was going to initiate them (donor), so that the axis of the donor detonator and the axes of the receiver tubes remained visibly parallel.

The drawbacks of these connectors resulted from the direction of the initiating energy of a detonator and from its excessive power, causing a large amount of shrapnel that destroyed the receiver tubes, as well as making an excessive amount of noise.

For these reasons, the next generation of connectors, the current state of the art, consists of donor detonators with a lower charge and plastic parts that allow the receiver tubes to be quickly attached to the explosive charge of the donor detonator, so that the axis of this and the axes of the receiver tubes are at right angles, with the aim of avoiding the problems of the direction of the initiating energy of the detonator's charge.

Thus, for example, U.S. Pat. No. 5,423,263 granted to Dyno Nobel Inc. on 13 Jun. 1995 discloses a connector block that transfers the initiation from a detonator inserted into the connector block to one or more shock tubes.

U.S. Pat. Nos. 5,171,935 and 5,398,611 from 15 Dec. 1992 and 21 Mar. 1995 respectively, granted to Ensign Bickford Company, describe plastic blocks with a space inside to house a low-energy detonator, the active end of which is next to a slot into which the shock tubes to be initiated are inserted.

However, reducing the charge of the donor detonator whilst keeping the same size diameter means that said charge must be concentrated into a space at the end of it, which in turn causes new problems that have been covered by different inventions, some of which aim to position the detonator more precisely within its housing.

Thus, in U.S. Pat. No. 5,499,581 granted to Ensign Bickford Company on 19 Mar. 1996, a method is described for better positioning and fixing of the initiating detonator in the corresponding casing inside the connector, by means of a moveable fixture.

On many occasions the proposed innovations aim to facilitate or improve the positioning of the receiver shock tubes in the slot next to the end of the donor detonator that contains the explosive charge.

Thus, U.S. Pat. No. 5,703,319 granted to Ensign Bickford Company on 30 Dec. 1997 describes a connector block that has houses a low energy detonator, as well as a clip forming a slot with the end of the detonator where the shock tubes to be initiated are situated.

Lastly, U.S. Pat. No. 5,792,975 granted to the same company on 11 Aug. 1998 includes several different improvements in the functionality of the connector block and provides a method for assembling the detonator inside said connector block, giving a combination of detonator and connector.

The solutions available with the current state of the art show a connector block with a housing into which a detonator is inserted that is positioned and fixed by means of various mechanisms. The explosive charge of the detonator is situated in such a way that, together with the (more or less) flexible piece that forms part of the connector block, there is a slot in which one or several shock tubes to be initiated (receivers) can be lodged.

By way of an example, international patent WO 03/023316 A1 from 20 Mar. 2003, granted to Orica Explosives Technology, discloses a device comprising a plastic connector block housing a detonator with an active end (from the initiation point of view) around which the receiver shock tubes are situated, immobilised by a clip and a closure that prevents their accidental removal.

Several problems could be linked to connector blocks manufactured according to the current state of the art, among which is the possibility of either intentionally or inadvertently separating the connector block from the detonator housed inside it and using it for purposes other than those for which it was designed and manufactured.

On the other hand, the dimensions and shapes of detonators, as well as the techniques used to manufacture the metal casing of which they are made, determine the fact that the back of the detonator is an area of irregular behaviour when there is a detonation transmission, which can cause shrapnel to destroy some of the receiver tubes or can limit the number of receiver tubes that may be initiated simultaneously.

Some solutions using energy produced on the cylindrical surfaces of the detonator, instead of the end, to initiate the tubes, require special detonators that are difficult or expensive to produce, unless one renounces the idea of using low energy detonators.

Low energy detonators have the advantage of greatly reducing the amount of metal shrapnel produced, but it does not completely avoid this.

DESCRIPTION OF THE INVENTION

This invention attempts to solve the aforementioned problems whilst also reducing the number of components in the block and simplifying its assembly.

This invention comprises a connector block that does not require the insertion of a detonator. It has a plastic block or main body with a linear housing loaded with explosive, next to which is a slot for the shock tubes, of which there could be a varying number depending on the design.

The plastic material chosen to offer the best thermal and mechanical features is of low flexibility.

In the preferred design form of this invention, the linear explosive casing can be substituted for a straight cylindrical or prismatic surface, the longitudinal axis of which is very close to the outer surface of the connector that forms the slot for inserting the receiver shock tubes, so that the thickness that separates the two surfaces is less than 1.5 mm.

The housing for the receiver shock tubes is placed so that their axes are at right angles to the axis of the linear explosive charge of the connector block.

To keep the receiver tubes in place, adjacent to the surface of the connector block behind which is the explosive charge and at right angles to the axis of said charge, there is a tongue or clip that allows the receiver tubes to be inserted with a reasonable amount of force but prevents the free movement of the tubes or their inadvertent detachment or removal.

The design of this tongue or clip was chosen for the greatest possible precision when positioning and adjusting the tubes in the area where the explosive charge of the connector block is situated. Outside this area there may be sufficient space to insert and position the tubes without too much force.

The connector block also has its own delay device, which is similar to those used to delay detonators. This is situated in a cylindrical housing formed from the body of the connector block itself, so that its final end in the combustion progression connects directly with the linear housing containing the explosive that initiates the receiver shock tubes.

Great importance is given to securely fixing the delay device when inserting it into its housing, as well as making sure that there are no gaps between the cylindrical surfaces of the delay device and the connector block, the body of the delay device having for this reason one or several ridges that become embedded in the cylindrical surface of the housing around the body of the connector block in which it is situated.

The donor shock tube, which will send the wave that is to be transmitted with the programmed delay to the other receiver tubes, is positioned with the final end, in terms of the progression of the wave, in contact with the beginning end of the delay device by means of a closure that situates it precisely whilst providing a hermetic and inviolable closure.

The aforementioned closure comprises a revolving (at least partially) body made from a medium-flexibility plastic and it has a cylindrical orifice into which the end of the donor tube is inserted until it reaches its final position, securing it either by squeezing, gluing or using mechanical fixtures such as any kind of soldering or the use of pressure rings or clamps.

The outer surfaces of the body of the closure adapt to the body of the connector block and are joined by squeezing, glue, screws, bendable parts or a combination of these, ensuring that it is both hermetic and inviolable.

One of the advantages of this invention is that the explosive charge is distributed linearly and adapted to the needs of the designed connector block, giving it a similar initiating capacity for all the receiver tubes inserted into the slot and preventing it from producing metal shrapnel.

Another notable advantage is that connector blocks can be designed to initiate different quantities of receiver tubes, for example, for up to 6 tubes, or for up to 10 tubes, or for up to 12 tubes, etc., allowing the system to be used in underground work where this possibility is required.

Another advantage of this invention is that it makes it possible to vary the angle between the axis of the main body (aligned with the donor tube and with the delay device) and the axis of the explosive charge, allowing ergonomic designs that relieve the effort on the blaster's wrists in blasts with numerous holes.

DESCRIPTION OF THE DRAWINGS

To complement this description and in order to aid a better understanding of the invention's characteristics, according to a preferred practical embodiment of the invention, there is a set of illustrative and non-limiting drawings integral to said description, which are as follows.

PREFERRED EMBODIMENT OF THE INVENTION

Figure 1:
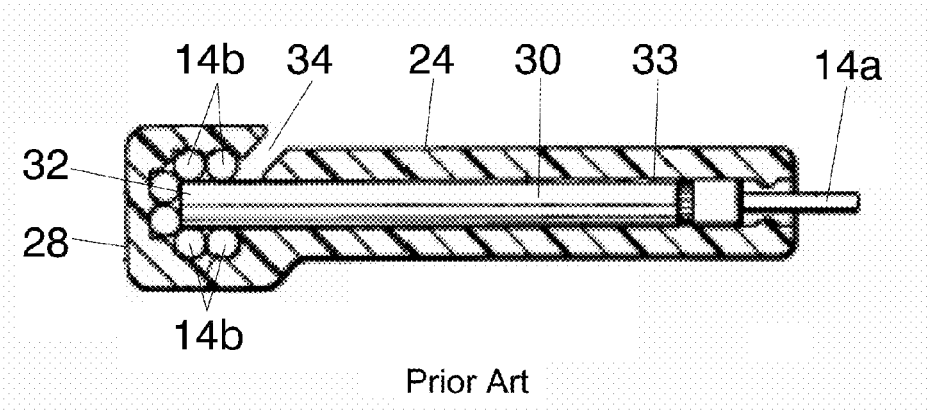
FIG. 1 Shows a cross-sectional view of a connector block according to the Prior Art, wherein the component elements are illustrated, specifically the aforementioned connector block referred to as (24), the detonator (30) and the receiver tubes (14*b*). The figure comes from one of the patents mentioned in the Background of the Invention section.
Figure 2:
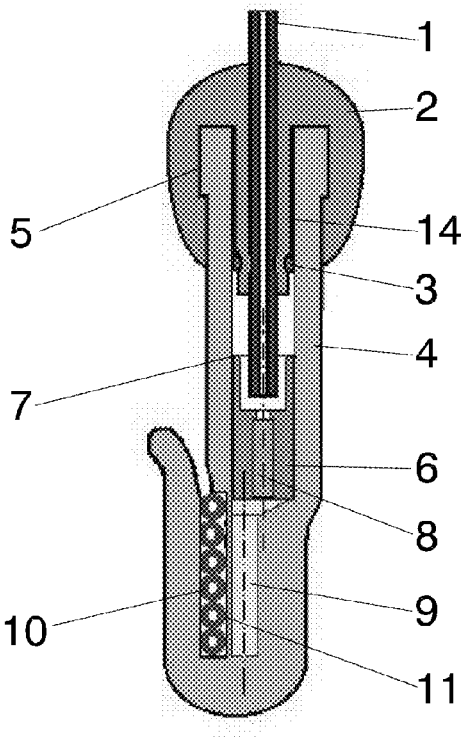
FIG. 2 Shows a similar section to the preceding figure, but it corresponds to an embodiment of a connector block for shock tubes according to the present invention.

In view of the figures described, particularly FIG. 2, it may be seen that the connector block proposed by the invention comprises a donor tube (1), which is securely joined to the closure (2) by means of a pressure ring (3) and the closure (2) is in turn hermetically joined to the body (4) of the connector block by the contact surface (5) that guarantees that it is all kept together and prevents water from entering during its use.

The body (4) of the connector block is equipped with devices that carry out the characteristic functions of the connector block, specifically the delay device (6), which is fixed to the body (4) of the connector block by means of a ridge (7) and contains the pyrotechnic delay formula (8) that provides the required interval of delay, and the explosive (9) which, when initiated by the pyrotechnic delay formula (8), detonates and initiates the receiver shock tubes (10) positioned in the slot (11).

The delay device (6) must be securely fixed in its housing for the system to work correctly, for which said delay device (6), made from a bendable material such as aluminium, zinc, brass, etc., is equipped at the top end with a thin cylindrical wall (12) that dents when it is subjected to a radial force, making room for the ridge (7) which is driven into the cylindrical surface of the plastic body (4) of the connector block. The denting force is achieved by means of a punch (13), such as one of those shown in FIG. 8, which is used to insert the retractable part into its housing, and which can have a conical operative end, with an angle of between 80 and 130°, depending on the material used to make the delay device.

Figure 5:
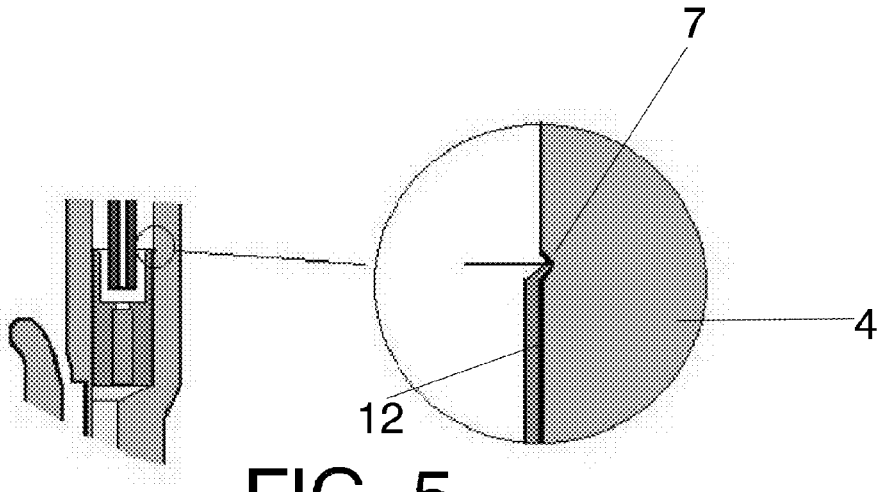
FIG. 5 Shows a detail of the positioning and fixing of the delay device by means of a single ridge.
Figure 6:
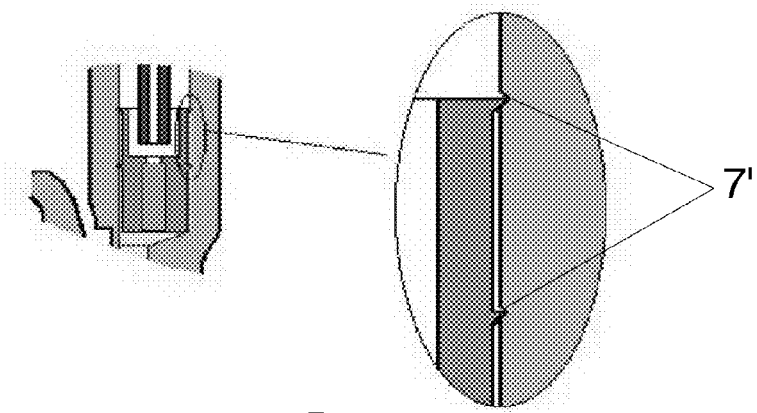
FIG. 6 Shows a similar detail to that of the preceding figure but in which said positioning and fixing is done by means of two or more ridges.

As an alternative to this practical embodiment shown in FIG. 5, the delay device (6) can be equipped, during the manufacturing process, with two or more ridges (7'), as shown in FIG. 6, with a diameter greater than that of the inside of the housing. This delay device (6) can be made by machine or moulded. The sides of the ridges (7') form an angle in relation to the axis of the delay device of between 100 and 125° which facilitates their insertion.

Figure 7:
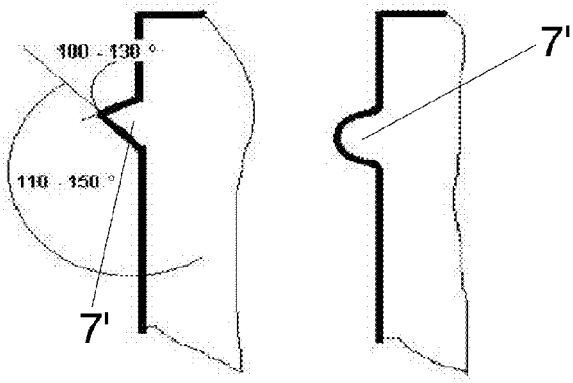
FIG. 7 Shows two alternatives for the shapes of the ridges in designs such as that of FIG. 6.
Figure 8:
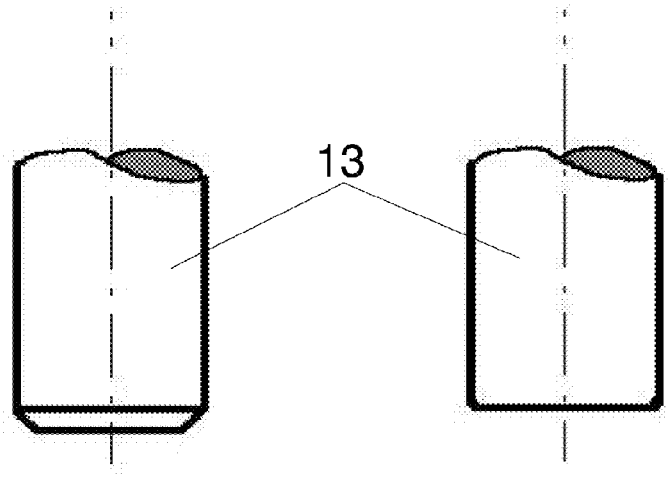
FIG. 8 Shows two types of embodiment for the punches for inserting delays.

It is possible for the ridges (7') to be angular or rounded, as shown in FIG. 7. In any case, the punch (13) must be perfectly cylindrical, as is shown in FIG. 8.

Given that one of the requirements for putting the invention into practice is that the donor shock tube (1) is securely inserted into the connector block, without any possibility of its being dislodged by the forces to which they tend to be subjected when used or by simple or intentional actions, as generally happens with many existing designs, the material of the closure (2) has been designed to be slightly more flexible than that of the body (4) of the connector block, to which it is joined by means of the pressure of distortion that allows it to be pushed into its final position. In order to reinforce the fixture, adhesive suitable for the type of material used, ultrasonic soldering or another method may be used.

Figure 12:
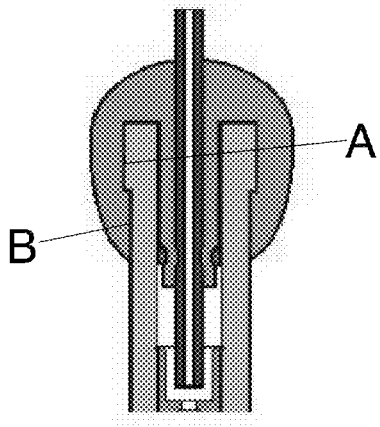
FIGS. 12, 13 and 14 Show different possibilities for the closure and the means of fixing the donor tube to said closure, and of the means of fixing these parts to the body of the connector block.

In this embodiment, shown in FIGS. 2 and 12, first the tube (1) is inserted into the closure (2), which is equipped with the bendable pressure ring (3), which could be for example a metal ring. The ring is then bent so that it fixes the tube (1) to the inner cylindrical wall (14) of the closure, to which a layer of adhesive may be applied for reinforcement.

The choice of material and the size of the pressure ring is vitally important to achieve the desired effect. The tube must not become dislodged when subjected to a traction test with a charge equivalent to that used for the tubes in blast-hole detonators. Furthermore, nor must the aforementioned inner diameter (in the area in which it is set) be smaller than that obtained when setting the blast-hole detonator tubes.

The closure (2), tube (1) and pressure ring (3) are inserted into the housing of the body (4) of the connector block, being securely fixed and connected thanks to the difference in diameters between the outer cylindrical surface (A) of the body of the connector block and the inner cylindrical surface (B) of the closure.

Figure 13:
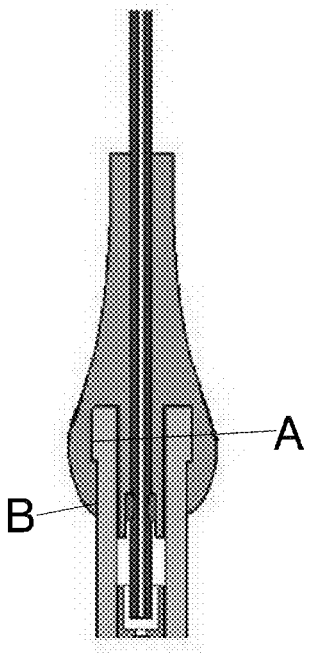

This joint can be made more hermetic and more mechanically resistant by increasing the contact surface between the closure (2) and the tube (1), as the practical embodiment in FIG. 13 shows, where moreover the pressure ring (3) is of a flexible material and is situated between the outer cylindrical surface of the tube and the inner surface of the closure, thus making it hermetic as the correct dimensions cause them to be squeezed together.

Figure 14:
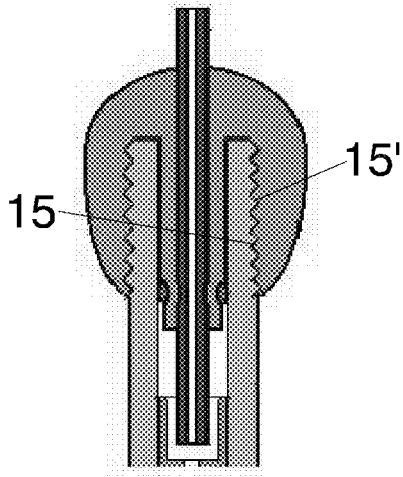

There is also a possibility, shown in FIG. 14, for the fixture of the closure (2) to the body (4) of the connector block to be brought about not by differences in the diameter of these parts, as in the preceding cases, but by screwing. For this, the body (4) of the connector block has a male thread (15) that fits into the female thread (15') of the closure (2). To prevent the closure (2) from becoming unscrewed, various measures could be used, such as strong adhesives, soldering or any other measures.

Figure 3:
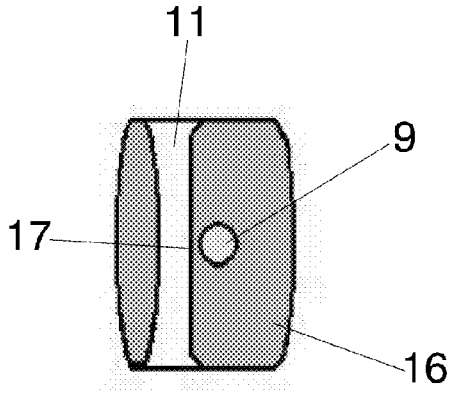
FIG. 3 Shows a cross-sectional detail of the explosive charge, according to an initial embodiment for the invention wherein it is cylindrical.
Figure 4:
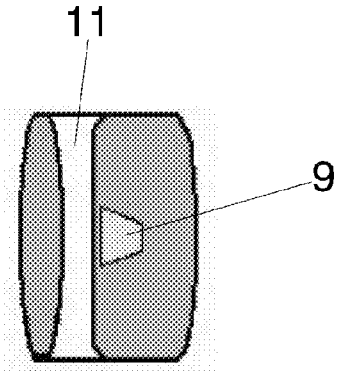
FIG. 4 Shows a similar illustration to that of FIG. 3, but it corresponds to a prismatic-shaped explosive charge.

As regards the receptacle for the explosive (9), this can be cylindrical as shown in FIG. 3, or prismatic with an isosceles-trapezoid section as in FIG. 4, and said explosive (9) is in any case in contact with the end of the delay device (6) and surrounded by resistant walls (16) except on the surface (17) next to the slot (11) for inserting the receiver tubes (10), where said wall is very thin, as illustrated in the aforementioned FIGS. 3 and 4.

The linear charge of explosives comprises between 30 and 150 300 mg/cm and it is possible to use different types like mixtures and combinations of explosives, such as lead nitride, lead trinitroresorcinate, diazodinitrophenol, pentrite, exogen, octogen, etc.

Figure 15:
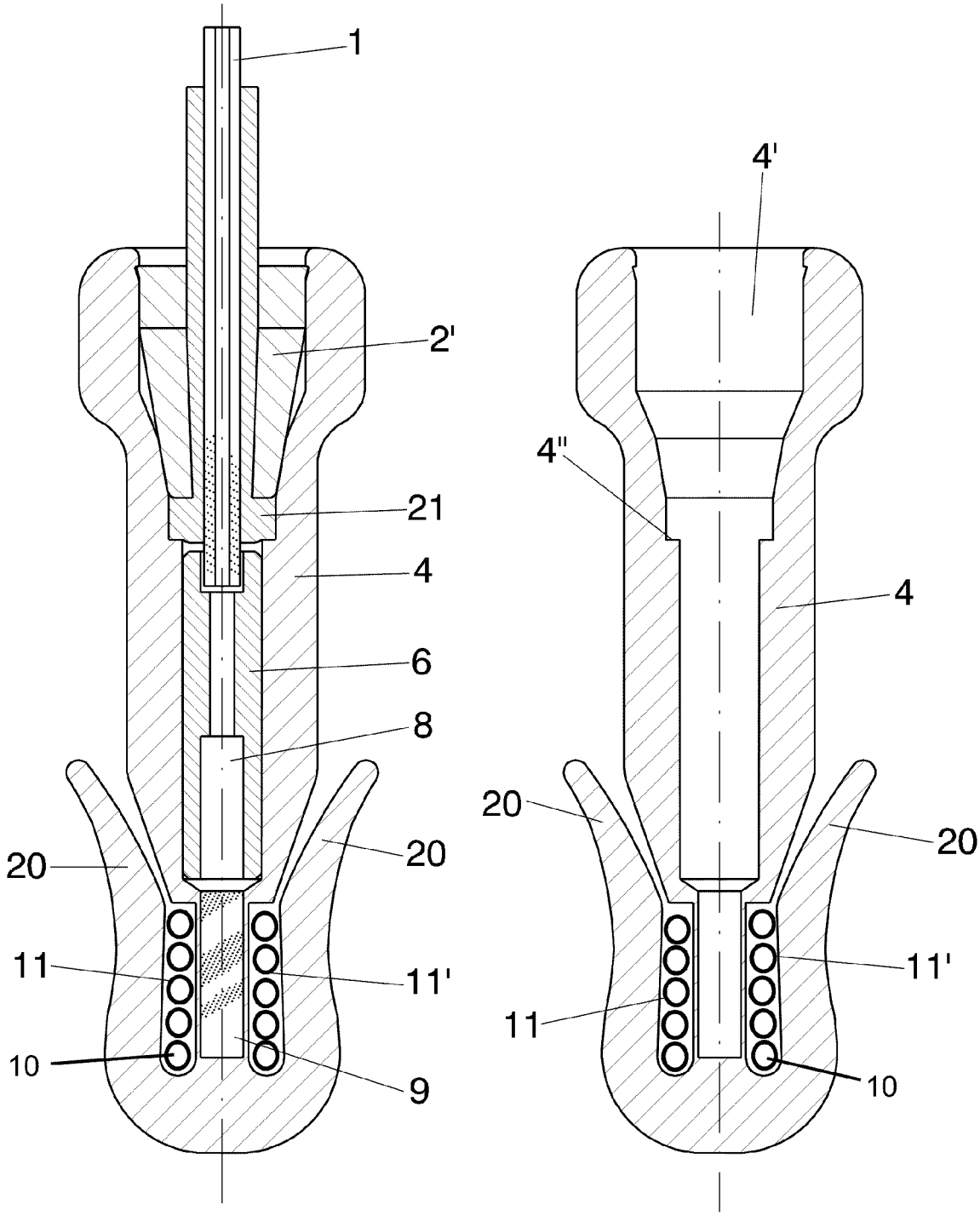
FIGS. 15 and 16 Show another variant of an embodiment of the body of the connector block and its closure.

In the example of a practical embodiment in FIG. 2 the axis of the cylindrical receptacle for the explosive charge (9) and that of the delay device (6) wherein the pyrotechnic delay formula is housed (8) are in the same direction, and the axes could be apart as in FIG. 2 or they could coincide (FIG. 15). To load it, first the explosive is put in and then the delay device is inserted, which also acts as a closure for the explosive.

In this design, the housing for the charge can be a cylindrical cross-section, as shown in FIG. 3, with a thickness of the wall between the flat outer side and the cylindrical inner side of preferably less than 1.5 mm, or a trapezoid cross-section, as shown in FIG. 4, with a similar thickness of the wall between the inner and outer sides. In general these values may also be used with other designs.

Figure 9:
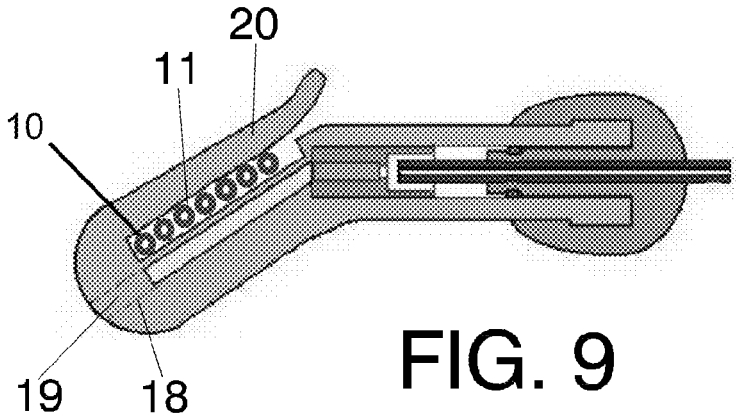
FIGS. 9, 10 and 11 Show respective possibilities for the position of the explosive charge in relation to the position of the delay device.
Figure 10:
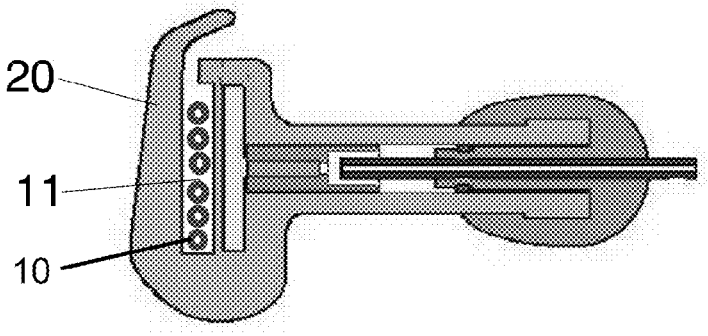

FIG. 9 shows a variant of the embodiment wherein the axes of the cylinders housing the explosive charge (9) and the delay device (8) respectively, form an obtuse angle in relation to each other in order to facilitate the insertion of the receiver tubes (10) into the slot (11). In this case, the loading procedure is different from the previous one, as the delay device is inserted first and then the explosive is put in through the orifice (18), which is then closed off with a bung (19). FIG. 10 shows another variant of the embodiment wherein both cylinders form a right angle. The loading procedure is similar to that explained for the embodiment in FIG. 9.

Figure 11:
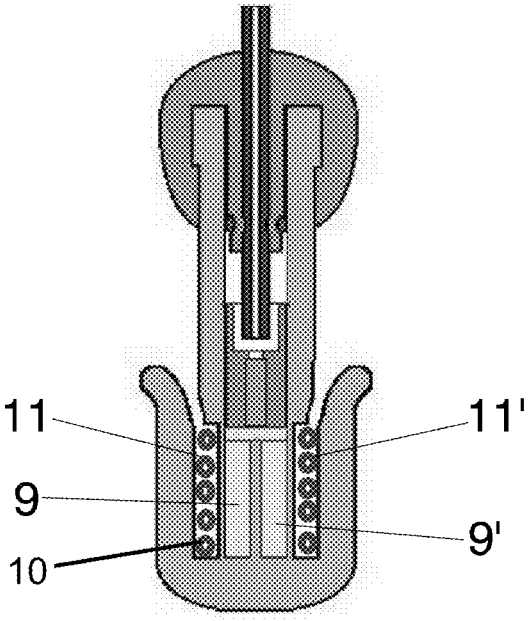

FIG. 11 shows another variant of the embodiment which features the inclusion of two parallel explosive charges (9-9') corresponding to two slots (11-11') for inserting the receiver tubes (10). This design also allows for an embodiment with a single explosive charge with a larger diameter.

Figure 16:
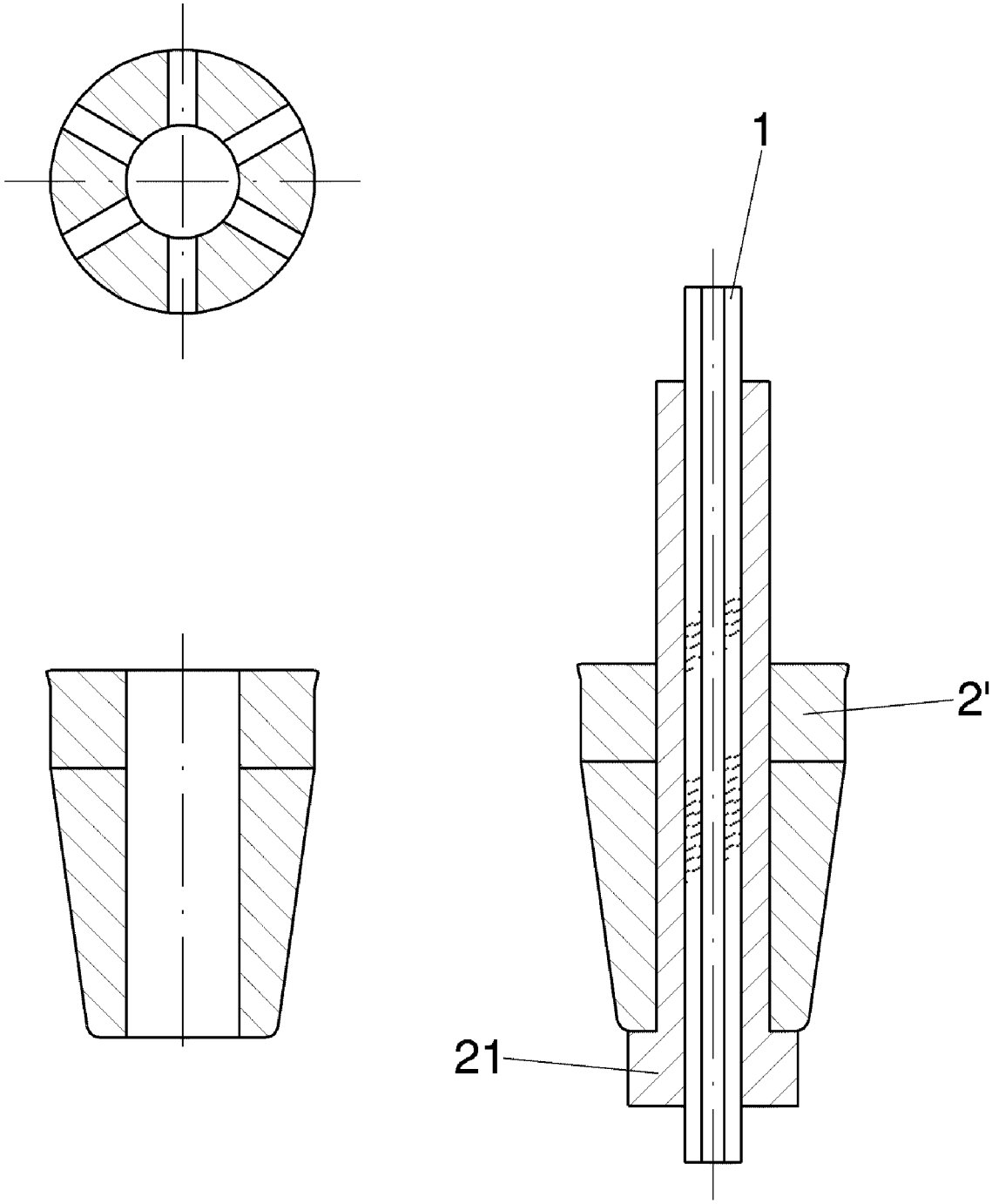

Lastly, FIGS. 15 and 16 show another variant of the embodiment wherein the connector block includes two insertion slots (11-11') and a single explosive charge (9) and the axis of the cylindrical receptacle of the aforementioned explosive charge (9) and that of the delay device (6) in which the pyrotechnic delay formula is housed (8) coincide.

These same figures show a variant of the embodiment of the closure mechanism of the body (4) of the connector block which comprises closure (2') which is predominantly conical and is inserted whole into the entrance (4') of the body (4) of the connector, which is shaped in order to receive the aforementioned closure (2'). The entire closure (2') is lodged in the entrance (4') of the connector block, without projecting out of it as in the case of the other embodiments.

Likewise, the closure (2') has a central orifice with a diameter that is the same as the outer diameter of the gasket that is previously fitted to the donor tube (1) to make it all fit more hermetically. This gasket (21), which could be made of rubber, is wider at the bottom in order to, on the one hand, fit against the small lower wall (4") inside the entrance (4'), and on the other hand, ensure that the closure is fitted properly (2').

In order to ensure that the receiver tubes are initiated properly, the clip (20) that retains them against the wall behind which is the explosive charge (9), must be sufficiently rigid and resistant to keep them securely held against it, at least in the central area where the explosive charge (9) is situated. For this, it is preferable to design a clip that is reinforced in the section where it joins the body (4) of the connector block, as shown in FIG. 10, which can be used in all the designs depending on the length of the slot (11).

The slot (11) section and the profile of the clip (20) have been designed so that, in order to insert the receiver tubes (10), it will be necessary to exert a reasonable amount of force, so that they are prevented from moving by the pressure of the clip (20).

The clip (20) exerts a pressure on each receiver tube (10) that is at its maximum nearest to the explosive charge (9) and progressively diminishes in both directions away from this area.

The invention claimed is:

1. A connector block for shock tubes, said connector block comprising a body (4), a donor tube (1), at least one slot (11), and a delay device (6), wherein said delay device comprises a corresponding pyrotechnic delay formula (8), and an explosive charge (9), wherein said explosive charge is contained by the body of the connector block without the need for a metal casing or any metal part, wherein at least one receiver tube (10) is inserted in the at least one slot (11) and said at least one receiver tube (10) is situated coplanarly at right angles adjacent to and along the length of the explosive charge (9), and wherein said delay device (6) is secured inside the body (4) of the connector block using at least one ridge (7) which becomes embedded in the inner wall of said body (4).

2. The connector block for shock tubes according to claim 1, wherein said at least one slot (11) is situated in parallel and on either side of said explosive charge (9), wherein said connector block may include a single explosive charge (9) or two explosive charges (9-9') which are also parallel.

3. The connector block for shock tubes according to claim 1, wherein said body (4) of the connector block comprises one or two straight slots (11-11'), where one or two sets of receiver tubes (10) are held.

4. The connector block for shock tubes according to claim 1, wherein said delay device (6) and said corresponding pyrotechnic delay formula (8) are situated coaxially in relation to the explosive charge (9).

5. The connector block for shock tubes according to claim 1, wherein said delay device (6) and said corresponding pyrotechnic delay formula (8) are parallel to the explosive charge (9).

6. The connector block for shock tubes according to claim 1, wherein said delay device (6) and said corresponding pyrotechnic delay formula (8) are at an obtuse angle to the explosive charge (9).

7. The connector block for shock tubes according to claim 1, wherein said delay device (6) and said corresponding pyrotechnic delay formula (8) are at right angles to the explosive charge (9).

8. The connector block for shock tubes according to claim 1, wherein said ridge (7) is obtained by distorting an entrance to a tubular sector and a cylindrical wall (12) of the delay device (6) inside the body (4) of the connector using a punch (13).

9. The connector block for shock tubes according to claim 1, wherein said delay device (6) includes at least one ridge (7-7') around the delay device perimeter, wherein said at least one ridge of said delay device is of a greater diameter than a cylindrical wall (12) of the body (4) of the connector, and wherein said at least one ridge becomes embedded in the wall of the body using a punch (13), when said delay device (6) is fitted into the body (4).

10. The connector block for shock tubes according to claim 1, wherein said body (4) further comprises an entrance (4') and a closure (2), wherein the donor tube (1) passes through said closure and acts as a seal between the donor tube (1) and the body (4) of the connector block.

11. The connector block for shock tubes according to claim 10, further comprising a pressure ring (3), wherein said pressure ring (3) is located between the inside of the closure (2) and the body (4) of the connector, wherein said pressure ring (3) distorts an inner section (14) of the closure so that said closure is pressed against the donor tube (1).

12. The connector block for shock tubes according to claim 10, wherein said closure (2) is fixed to the body (4) of the container using a tongue and groove joint with tiered, complementary surfaces (5), and said fixing is achieved using a suitable adhesive or equivalent thereof.

13. The connector block for shock tubes according to claim 10, wherein said closure (2) is fixed to the body (4) of the container using complementary screws (15-15'), and a tongue and groove joint may be strengthened with an adhesive or equivalent thereof.

14. The connector block for shock tubes according to claim 10, wherein said closure of the body (4) of the connector is a closure (2') that is inserted into the entrance (4') of the body (4) of the connector, wherein said closure (2') comprises an inner orifice and a gasket (21) fitted to the donor tube (1), and wherein the closure (2') is entirely housed inside said entrance (4').

15. The connector block for shock tubes according to claim 14, wherein said closure (2') is of a conical shape and the entrance (4') of the connector block is adapted to receive said closure (2').

16. The connector block for shock tubes according to claim 14, wherein said entrance (4') comprises a smaller inner diameter lower wall (4"), and wherein the gasket (21) fits the lower wall (4").

17. The connector block for shock tubes according to claim 16, wherein said gasket (21) is made of rubber.

18. The connector block for shock tubes according to claim 14, wherein said gasket (21) is made of rubber.

19. The connector block for shock tubes according to claim 1, wherein said explosive charge (9) is housed in a cylindrical or prismatic receptacle and wherein said explosive charge is selected from the group consisting of lead nitride, lead trinitroresorcinate, diazo-dinitrophenol, pentrite, exogen, and octogen.

20. The connector block for shock tubes according to claim 1, wherein the connector block does not include a detonator.

* * * * *